United States Patent [19]

Bezos et al.

[11] Patent Number: 4,785,197

[45] Date of Patent: Nov. 15, 1988

[54] TILT SWITCH

[75] Inventors: Angel P. Bezos, Montgomery County, Md.; Emilio A. Fernandez, Fairfax County, Va.; James F. Shockley, Montgomery County, Md.

[73] Assignee: Pulse Electronics, Inc., Rockville, Md.

[21] Appl. No.: 87,333

[22] Filed: Aug. 20, 1987

[51] Int. Cl.[4] ..... G08B 21/00

[52] U.S. Cl. ..... 307/116; 340/573; 307/117

[58] Field of Search ..... 307/9 R, 10 R, 10 BP, 307/10 AT, 116, 117, 118; 200/61.52, 61.83, 61.47, 52 R, 61.51, 61.48, 61.88, 61.44, 61.45 M, 61.45 R; 180/282, 284, 287, 274; 446/175, 303; 340/686, 687, 689, 573, 321, 953, 571, 566; 33/366, 379, 365, 367; 335/54, 55, 58; 361/91, 100; 219/507, 509, 518, 520, 521, 257

[56] References Cited

U.S. PATENT DOCUMENTS

| | | | |
|---|---|---|---|
| 3,614,763 | 10/1971 | Yannuzzi | 340/321 |
| 3,866,204 | 2/1975 | Barkley | 340/573 X |
| 4,203,101 | 5/1980 | Towsend | 219/257 X |
| 4,227,188 | 10/1980 | Peterson | 340/566 |
| 4,318,245 | 3/1982 | Stowell et al. | 446/303 |
| 4,399,432 | 8/1983 | Lunn | 340/573 |
| 4,482,168 | 11/1984 | Oberleitner | 200/61.52 X |
| 4,520,257 | 5/1985 | Schwob et al. | 219/257 X |
| 4,536,755 | 8/1985 | Holzgang et al. | 340/573 |
| 4,580,038 | 4/1986 | O'Loughlin | 219/507 X |
| 4,617,525 | 10/1986 | Lloyd | 340/573 |
| 4,661,685 | 4/1987 | Contri | 219/250 |
| 4,673,798 | 6/1987 | Contri et al. | 219/251 X |
| 4,686,352 | 8/1987 | Nawrot et al. | 340/686 X |
| 4,692,589 | 9/1987 | Borsari et al. | 219/251 |

*Primary Examiner*—William M. Shoop, Jr.
*Assistant Examiner*—Paul Ip
*Attorney, Agent, or Firm*—C. Lamont Whitham; Michael E. Whitham

[57] ABSTRACT

A gravity operated switching circuit, having particular application in end of train equipment, allows the microprocessor circuit board in the equipment to be turned off. The circuit turns the power off when the equipment is laid on its side after a predetermined time constant, and when the equipment is again mounted in an upright position, the power is turned on after a different predetermined time constant. A modification of the basic circuit requires a reset button to be manually pressed to restore power after the equipment is again mounted in an upright position.

8 Claims, 1 Drawing Sheet

TILT SWITCH

BACKGROUND OF THE INVENTION

1. Field of the Invention

The present invention generally relates to gravity operated switching circuits for power supplies for electronic equipment and, more particularly, to a switching circuit having particular application in end of train signalling equipment which automatically turns the signalling equipment off with a predetermined time delay after the equipment is removed from use and laid on its side for storage.

2. BACKGROUND OF THE INVENTION

It is known in the prior art to provide electrical and electronic devices with a gravity operated switch so that, if the device is tipped over or intentionally laid on its side, the power to the device is turned off. The purpose of turning off the power may be to conserve power, as in battery powered devices, or as a safety precaution. An example of the former is shown in U.S. Pat. No. 2,492,837 to Briggs which discloses a portable signal light, powered by a battery, which includes a mercury switch that is open when the light lays on its side. The switch is closed only when the light is in a substantially upright position. As a safety precaution, such switches may be incorporated into electrical appliances to prevent accidental fires if tipped over while unattended.

End of train signalling and monitoring equipment is becoming more widely used as a replacement for the traditional caboose. The information monitored, which typically includes the air pressure of the air brake line, is communicated by a battery powered telemetry transmitter to the crew in the locomotive. In addition, a marker light is required at the end of the train, and this too is battery powered. The end of train signalling and monitoring equipment is typically assembled into a compact unit which is designed to be mounted on the trailing coupler of the last car of the train.

Modern end of train equipment includes a microprocessor with a stored program designed to control the monitoring and signalling functions of the equipment. Since the equipment is battery powered and it is important to conserve the power of the battery when the equipment is temporarily not in use, it is known to provide this equipment with a gravity operated switch, such as a mercury switch, so that when the equipment is removed from the coupler and laid on its side, many of the equipment functions are turned off. This operation is controlled by the microprocessor which may be programmed to provide different time constants for turning the equipment off and, when remounted on the coupler, on again. Basically, the functions which are controlled in this manner, that is turned off, are the flashing of the marker light and the the transmission of data by the telemetry transmitter. In order for this system to function, it is necessary for the microprocessor and all the related circuitry to be continuously powered, and this in turn produces a continuous drain on the battery.

SUMMARY OF THE INVENTION

It is therefore an object of the subject invention to provide a new and improved gravity operated switching circuit having particular application in end of train equipment which allows the microprocessor circuit board to be turned off thereby substantially conserving battery power.

According to the present invention, a separate circuit, independent of the microprocessor, is provided which turns power to the end of train equipment off when the equipment is laid on its side. The power is turned off after a predetermined time constant, and when the equipment is again mounted in an upright position, the power is turned on after a different predetermined time constant. The circuit employs a Schmitt trigger implemented in CMOS (complimentary metal oxide semiconductor) technology which draws but minimum current. A modification of the basic circuit requires a reset button to be manually pressed to restore power after the equipment is again mounted in an upright position. This circuit uses a pair of CMOS Schmitt triggers connected as a latch to hold the circuit in the off condition even though the gravity operated switch is closed. This modified circuit is preferrably provided with a jumper which allows the latch feature to be disabled when it is not desired.

BRIEF DESCRIPTION OF THE DRAWINGS

The foregoind and other objects, advantages and aspects of the invention will be better understood from the following detailed description of the preferred embodiments of the invention with reference to the drawings, in which.

DETAILED DESCRIPTION OF THE PREFERRED EMBODIMENTS OF THE INVENTION

Figure 1:
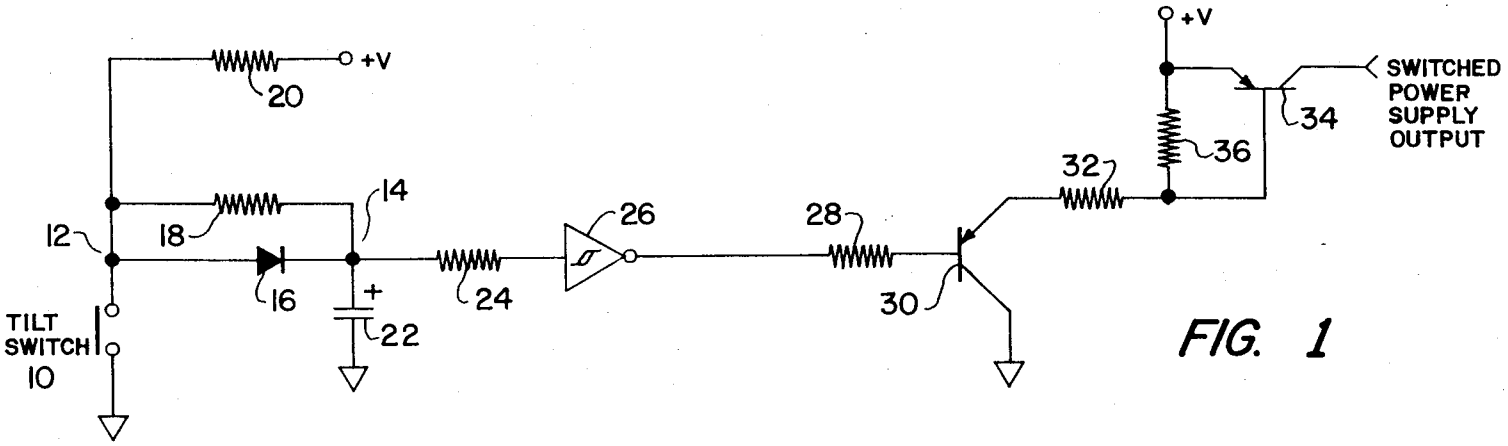
FIG. 1 is a schematic diagram of the basic circuit according to the invention.

Refering now to the drawings, and more particularly to FIG. 1, there is shown a gravity operated switching circuit which includes a tilt switch 10, which may be a mercury switch of known type. The switch is mounted in the end of train equipment so that when the equipment is in its upright position, the switch contacts are open; that is, the switch is non-conducting. The switch 10 is connected between a junction 12 and circuit ground. Between junction 12 and a second junction 14, there are connected in parallel a diode 16 and a resistor 18. The battery +V terminal is connected to junction 12 via another resistor 20. A capacitor 22 is connected between junction 14 and ground.

When the end of train equipment is in its upright position, the +V terminal of the battery is connected via resistor 20 and diode 16 to junction 14 to charge capacitor 22. Resistor 20 is a relatively low valued resistance so that the charging time constant is short. On the other hand, when the equipment is laid on its side, the tilt switch 10 closes thereby shorting junction 12 to circuit ground. Resistor 20 provides some isolation between the +V battery terminal and circuit ground, and a discharge path for capacitor 22 is established via resistor 18 to ground. The resistance of resistor 18 is relatively high so that the discharging time constant of the capacitor is much longer than the charging time constant. The reason for this is to make the equipment immune to the shocks and vibrations encountered in normal operation.

Junction 14 is connected via a resistor 24 to the input of an inverting CMOS Schmitt trigger 26. When the voltage across capacitor 22 reaches a predetermined level, the output from the Schmitt trigger 26 switches from a low value to a high value. The output of the Schmitt trigger is connected via resistor 28 to the base of an PNP transistor 30, which conducts only when the output of the Schmitt trigger 26 is a low value. The collector of transistor 30 is connected to circuit ground, while the emitter of transistor 30 is connected via a resistor 32 to the base of a second PNP transistor 34. The emitter of transistor 34 is connected to the +V terminal of the battery, and the collector of transistor 34 is connected to the power supply terminal of the end of train equipment. A resistor 36 is connected between the base and emitter of transistor 34 to provide base bias when transistor 30 is not conducting. Thus, transistor 34 is connected as a self-biased collector follower which is switched on or off by the conduction or non-conduction, respectively, of transistor 30.

Figure 2:
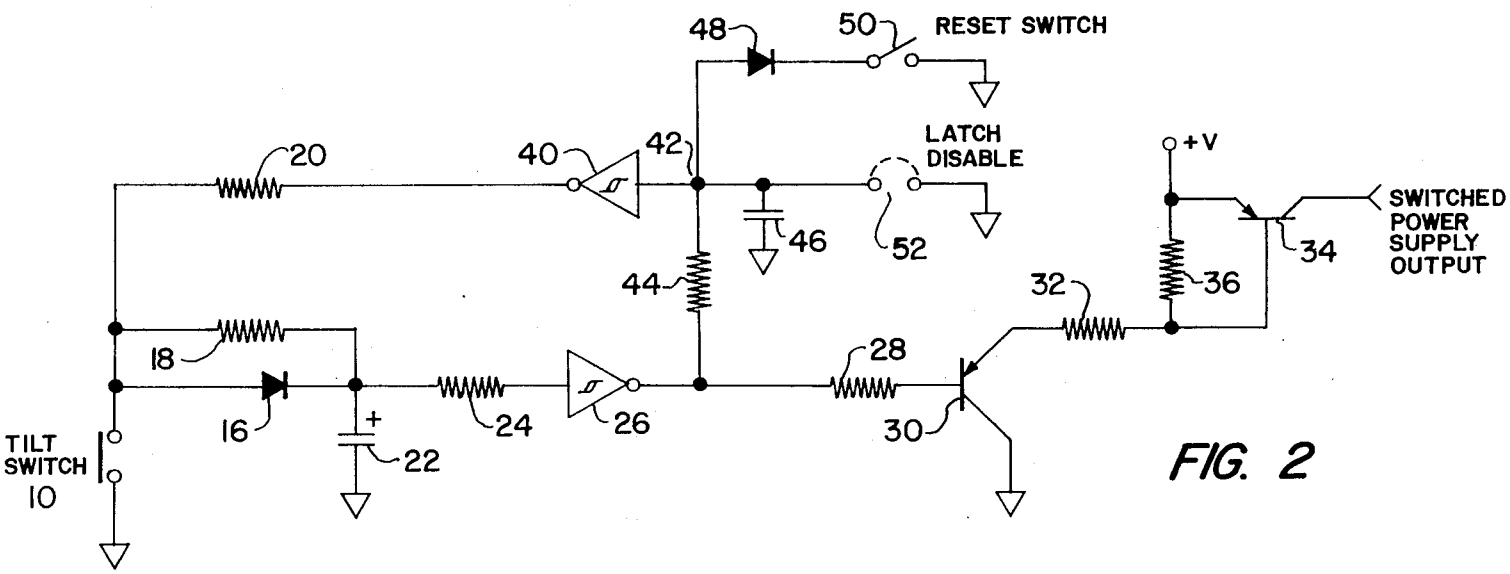
FIG. 2 is a schematic diagram of a modification of the basic circuit.

The circuit shown in FIG. 1 has the advantage of being quite simple and completely automatic in operation. In some applications, however, it has been found desirable to modify the basic circuit to provide a latching function so that the circuit does not immediately switch the power on when the end of train equipment is mounted in its upright position. Reference is now made to FIG. 2 of the drawing wherein like reference numerals designate the same components. In this modification, a second CMOS Schmitt trigger 40 is used in the circuit. This represents no additional expense since these Schmitt triggers are packaged as multiple units in a single integrated circuit (IC) package, and it is merely a matter of using what is already there. A specific example of the CMOS Schmitt triggers which may be used is commercially designated as a CD40106 IC.

The output of Schmitt trigger 40 is connected in place of the +V terminal of the battery to resistor 20, and the input of Schmitt trigger 40 is connected to a junction 42 and thence via a resistor 44 to the output of Schmitt trigger 26. Also connected to junction 42 is a capacitor 46 and a diode 48. The capacitor 46 is connected between junction 42 and circuit ground, while the diode 48 is connected between junction 42 and circuit ground via a reset switch 50. Junction 42 is further connectable to circuit ground via a jumper across terminals 52.

In operation, the discharging of capacitor 22 causes the output of Schmitt trigger 26 to switch to a high level thereby charging capacitor 46 via resistor 44. When the voltage across capacitor 46 reaches a predetermined level, the output of Schmitt trigger 40 switches to a low level. Thus, even if tilt switch 10 is again opened, capacitor 20 will not charge. However, by pressing the reset switch 50, capacitor 46 is discharged causing the output of Schmitt trigger 40 to switch to a high level so that capacitor 22 may again be charged. It will be observed that by connecting a jumper across terminals 52, the latch feature is disabled by connecting the input to Schmitt trigger 40 to ground. In this manner, only a single circuit need be manufactured but may be configured differently depending on a specific customer's requirements.

While the invention has been described in terms of a basic circuit with a latching modification, those skilled in the art will appreciate that the invention may be practiced with other modifications within the spirit and scope of the appended claims.

Having thus described our invention, what we claim as new and desire to secure by Letters Patent is as follows:

1. A gravity operated switching circuit for controlling the power supplied to a battery powered monitoring and signalling system having a microprocessor for controlling said monitoring and signalling functions comprising:

a tilt switch which is open in a first orientation of said monitoring and signalling system and closed in a second orientation of said monitoring and signalling system, said tilt switch being gravity operated;

timing means independent of said microprocessor connected to said tilt switch for providing a first control level with a first predetermined time constant when said tilt switch changes from a closed to an open condition and providing a second control level with a second predetermined time constant when said tilt switch changes from an open to a closed condition; and switched power supply means connected to said timing means for controlling the supply of electrical power to said battery powered monitoring and signalling system in response to said first and second control levels.

2. A gravity operated switching circuit as recited in claim 1 wherein said timing means comprises:

a capacitor and a source of current for charging said capacitor;

a charging path between said source of current and said capacitor for charging said capacitor when said tilt switch is open;

a discharging path for said capacitor established when said tilt switch is closed, the time constant of said discharging path being greater than the time constant of said charging path; and threshold means connected across said capacitor and responsive to a predetermined level of charge on said capacitor for providing said first and second control levels to said switched power supply means depending on whether or not said predetermined level of charge is exeeded.

3. A gravity operated switching circuit as recited in claim 2 wherein said threshold means includes a a Schmitt trigger which switches from a first output level to a second output level when said predetermined level of charge on said capacitor is exceeded.

4. A gravity operated switching circuit as recited in claim 1 wherein said timing means is normally inhibited from generating said first control level when said tilt switch changes from a closed to an open condition, said switching circuit further comprising reset means connected to said timing means for permitting said first control level to be generated.

5. A gravity operated switching circuit as recited in claim 4 wherein said timing means comprises:

a capacitor and a source of current for charging said capacitor;

a charging path between said source of current and said capacitor for charging said capacitor when said tilt switch is open, said charging path being enabled by said reset means;

a discharging path for said capacitor established when said tilt switch is closed, the time constant of said discharging path being greater than the time constant of said charging path; and threshold means connected across said capacitor and responsive to a predetermined level of charge on said capacitor for providing said first and second control levels to said switched power supply means depending on whether or not said predetermined level of charge is exeeded.

6. A gravity operated switching circuit as recited in claim 5 wherein said threshold means includes a a Schmitt trigger which switches from a first output level to a second output level when said predetermined level of charge on said capacitor is exceeded.

7. A gravity operated switching circuit as recited in claim 6 wherein in said reset means comprises:

a second capacitor and a second charging path, said second capacitor being charged through said second charging path in response to said second control level;

second threshold means connected across said second capacitor and responsive to a predetermined charge on said capacitor for inhibiting the flow of current from said source of current to said first capacitor;

said reset means being operative to discharge said second capacitor thereby allowing the flow of current from said source of current to said first capacitor.

8. A gravity operated switching circuit as recited in claim 7 further comprising shorting means for shorting said second capacitor and thereby disabling said second threshold means.

* * * * *